US005251388A

United States Patent [19]

Pozzobon et al.

[11] Patent Number: 5,251,388

[45] Date of Patent: Oct. 12, 1993

[54] LEVER DEVICE FOR SPORTS FOOTGEAR, PARTICULARLY FOR SKI BOOTS

[75] Inventors: Alessandro Pozzobon, Paderno Di Ponzano Veneto; Giancarlo Foscaro, Treviso; Adolfo Pozzebon, Sala D'istrana, all of Italy

[73] Assignee: Nordica S.p.A., Montebelluna, Italy

[21] Appl. No.: 44,884

[22] Filed: Apr. 9, 1993

Related U.S. Application Data

[63] Continuation of Ser. No. 783,759, Oct. 28, 1991, abandoned.

[30] Foreign Application Priority Data

Nov. 7, 1990 [IT] Italy ..... 40143 A/90

[51] Int. Cl.[5] ..... A43B 5/04; A43C 11/00

[52] U.S. Cl. ..... 36/50.5; 36/117; 24/68.5 K

[58] Field of Search ..... 36/117, 118, 119, 120, 36/121, 50; 24/68, 69, 70, 71

[56] References Cited

U.S. PATENT DOCUMENTS

| | | | |
|---|---|---|---|
| 931,441 | 8/1909 | Lindberg | 24/71 SK |
| 1,220,435 | 3/1917 | Lauer | 24/685 K |
| 2,897,558 | 8/1959 | Ronci | 24/71 SK |
| 3,593,435 | 7/1971 | Lange | 36/120 |
| 3,818,547 | 6/1974 | Baso | 24/70 SK |
| 4,593,483 | 6/1986 | Paris | 36/50 |
| 4,670,946 | 6/1987 | Olivieri | 36/50 |
| 4,796,337 | 1/1989 | Marxer | 24/71 SK |
| 4,905,384 | 3/1990 | DeMarchi et al. | 36/117 |

FOREIGN PATENT DOCUMENTS

| | | |
|---|---|---|
| 2712737 | 9/1978 | Fed. Rep. of Germany . |
| 2363294 | 3/1978 | France . |
| 2432280 | 2/1980 | France . |
| 504850 | 3/1971 | Switzerland . |

*Primary Examiner*—Steven N. Meyers
*Assistant Examiner*—Marie Denise Patterson
*Attorney, Agent, or Firm*—Guido Modiano; Albert Josif

[57] ABSTRACT

The lever device includes a lever arm arranged at at least one adapted seat defined on one of the flaps. At least one grip element for engagement members provided on the lever arm is associated with the other one of the flaps. The insertion of the lever arm within the adapted seat thus allows to have high strength characteristics and to not require a surface finish of good aesthetic quality, in view of its partial concealment, as well as to give the boot a neat aesthetic appearance, there being no protruding elements and because of the reduced size.

11 Claims, 4 Drawing Sheets

LEVER DEVICE FOR SPORTS FOOTGEAR, PARTICULARLY FOR SKI BOOTS

This is a continuation application of application Ser. No. 07/783,759 filed on Oct. 28, 1991, now abandoned.

BACKGROUND OF THE INVENTION

The present invention relates to a lever device which is particularly usable for sports footgear and in particular for ski boots.

Several types of lever used in ski boots are currently known; for this purpose this same Assignee has filed, on Jul. 17, 1975, an Italian patent, no. 1039897, disclosing a lever constituted by an arm which is pivoted, at one end, by means of an adapted pivot, to a pair of shoulders which are rigidly associated with a flap of the boot, said arm having a toothed region for interacting with the end of a hook which is associable, at its other end, with the other flap of the boot to be closed.

Said known lever requires a surface finish of good aesthetic quality, since it is in view on the boot; this therefore requires the use of materials, such as aluminum or plastics, which have an appreciable aesthetic appearance for the skier but do not, at the same time, have the high strength characteristics required to withstand the stresses and impacts to which they are subjected during sports practice.

In any case, the protrusion of the levers with respect to the lateral surface of the boot does not give said boot a neat aesthetic appearance, and said levers are subject, in case of impact with the snow, to accidental openings or breakages.

As a partial solution to this disadvantage, this same Applicant has filed, on Jan. 21, 1976, an Italian patent, granted as No. 1054289, disclosing a closure assembly for ski boots which, despite using a simplified structure, has been found to be difficult to close, due to the small action surface for the hand, on which the effort must then be exerted.

An Italian patent for utility model, no. 185645 filed on Jan. 20, 1981, also discloses a lever closure system, in particular for motorcycle boots, wherein the arm of the lever, which is still pivoted at one end at an adapted support which is rigidly associated with a flap, is inserted within adapted slots defined on another flap to be closed.

Even this solution, despite having a small number of components, has some disadvantages, such as the direct interaction of the lever arm with the flap to be closed, which entails breakages or deformations due to the different strength of the materials which are in contact with one another.

A French patent, published as No. 2432280 and filed on Aug. 3, 1978, discloses a closure device which is again composed of a U-shaped lever arm and having wings pivoted, at their ends, at an adapted support which is rigidly associated with a flap, a pivot being interposed between said wings and interacting with an adapted rack defined in, and protruding from, the other flap to be joined.

This solution has disadvantages, since the engagement between the lever arm and the rack is not always reliable, because the rack must necessarily be made of plastic material together with the flap of the boot and is thus made of a material which does not withstand the high stresses imparted while skiing.

Among the various described situations, the same Applicant of said French patent in fact provides the use of a single lever arm which has a toothed region which interacts with an adapted pivot which is transversely associated with the wings of a U-shaped bar which is pivoted in a cantilever manner to the other flap to be joined.

Even this solution, therefore, has the above described disadvantages; in addition there is a difficult closure operation for the skier, who must in practice rotate the lever arm through 180°.

As a partial solution to this disadvantage, this same Applicant filed, on Sep. 8, 1980, an Italian patent application, No. 22716 B/80, related to a closure device, particularly for ski boots, wherein there is a lever arm which is pivoted, at one end, at one of the flaps to be secured; the end of a traction element is articulated to a median portion of said lever element; said traction element is provided, at its opposite end, with a hook-like element which can be engaged in an engagement seat defined at the other flap to be secured; said traction element has means for adjusting its useful length and at least one substantially flexible portion.

Even this solution, however, constructively comprises a large number of components and protrudes outside the contour of the boot; the closure device furthermore extends considerably longitudinally and affects a very large area of the boot.

SUMMARY OF THE INVENTION

The aim of the present invention is to eliminate the disadvantages described above in known types by providing a lever device which allows to achieve the optimum securing of two flaps to be joined although at the same time it does not protrude outside the external contour of the boot.

Within the scope of the above aim, an important object is to provide a structurally simple lever device which can be manufactured with a small number of components.

Another important object is to provide a lever device which associates with the preceding characteristics that of allowing the use of less expensive materials without this affecting the overall aesthetic appearance of the boot.

Another object is to provide a compact lever device which thus occupies a reduced area of the boot.

Not least object is to provide a reliable, and safe in use, lever device.

This aim, these objects and others which will become apparent hereinafter are achieved by a lever device for sports footgear, particularly for securing two flaps of a ski boot, characterized in that it comprises a lever arm arranged at at least one adapted seat defined on one of said flaps, at least one grip element for engagement means provided on said lever arm being associated on the other one of said flaps.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
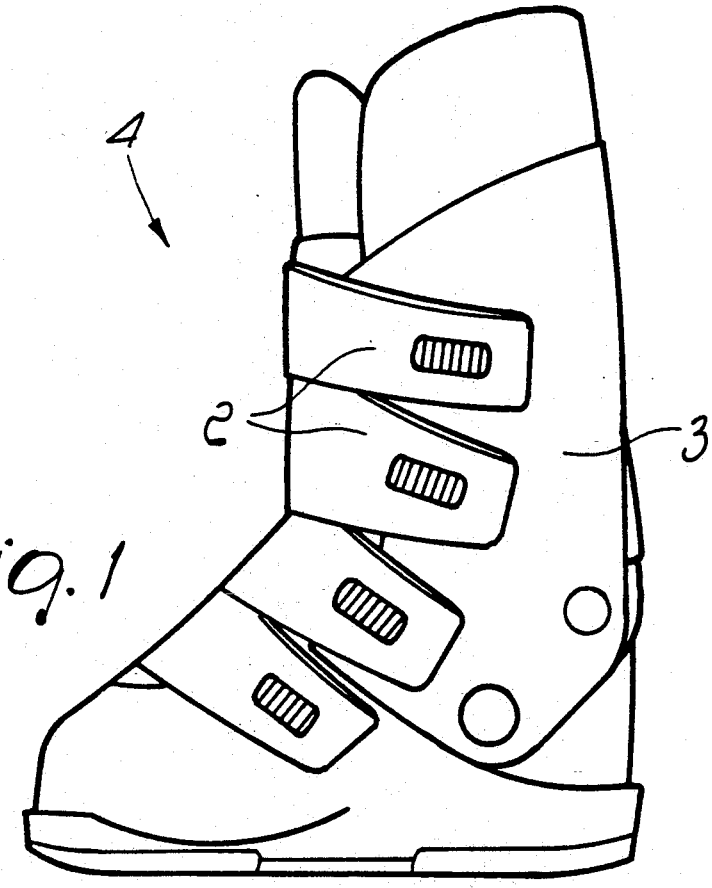
FIG. 1 is a side view of a ski boot having a lever device according to the invention.

With reference to the above figures, the reference numeral 1 indicates a lever device usable for sports footgear and in particular for securing a first flap 2 with a second flap 3 of a ski boot 4.

Figure 2:
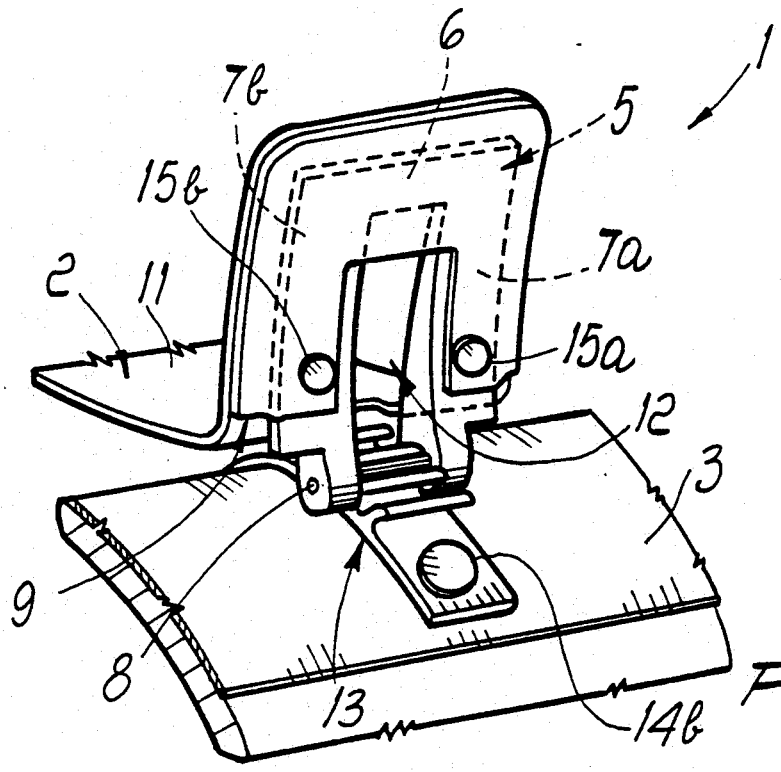
FIG. 2 is a partially sectional perspective view of the lever device in the open condition.
Figure 3:
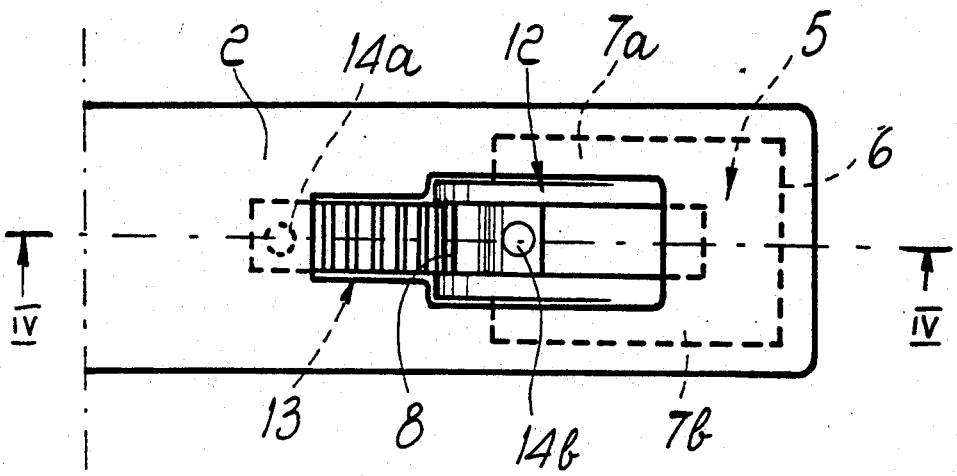
FIG. 3 is a top view of the lever device in the closed position.
Figure 4:
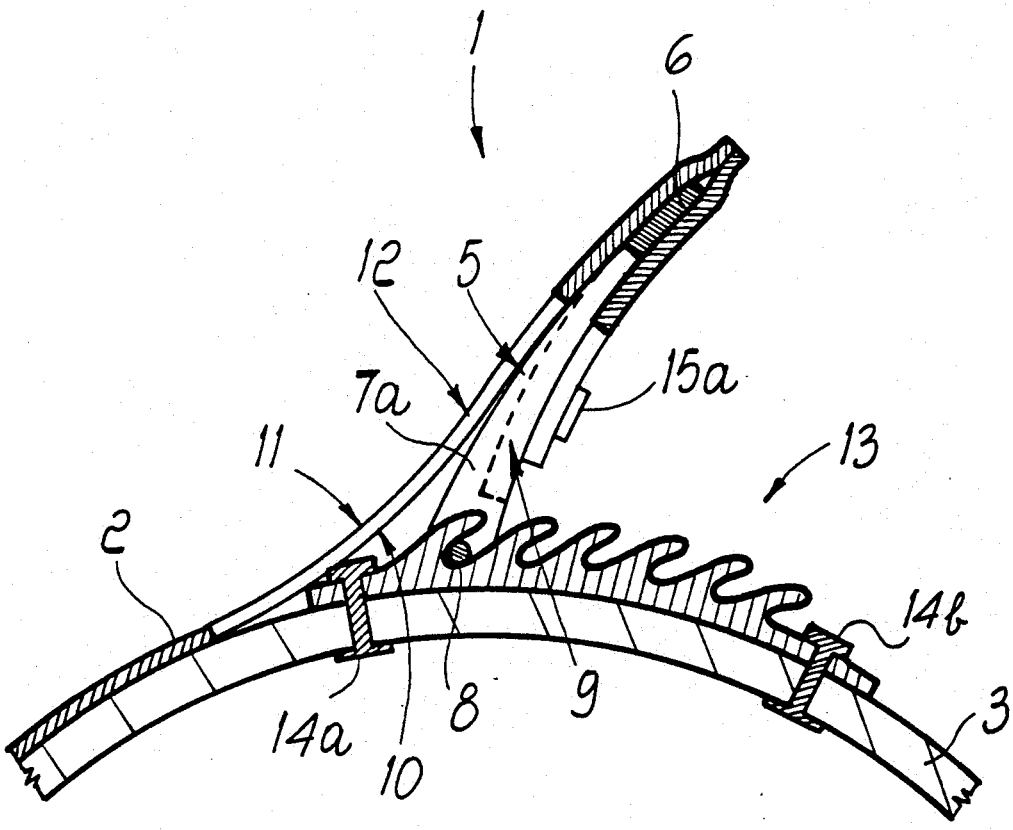
FIG. 4 is a view, taken along the sectional plane III—III of FIG. 3, wherein, for the sake of clarity, the lever arm has been placed in the open condition.

The lever device comprises at least one lever arm 5 which, in the particular embodiment illustrated in FIG. 2, is substantially U-shaped and comprises a base 6 for connecting a pair of wings 7*a* and 7*b*, between the free ends of which an engagement means, constituted by a pivot 8, is transversely interposed.

Said at least one lever arm 5 is associated, or temporarily associable with the boot, at an adapted hollowed seat 9 defined on the first flap 2 of the boot.

Said first flap 2 can advantageously be constituted by a strap which is rigidly associated with said first flap and/or protrudes therefrom.

Said first and second flaps can thus be constituted for example by a strap which protrudes from a quarter or from the shell and is connected, at its other end, to the quarter and/or to the shell.

In the particular embodiment, the lever arm 5 is partially inserted within the seat 9; the base 6 is concealed within said seat 9 and the pair of wings 7*a* and 7*b* is also partially concealed therein, whereas the ends of said wings, including the pivot 8, protrude from said seat at the inner surface 10 of the first flap 2 which faces the second flap 3.

A longitudinal opening 12 is furthermore defined at the seat 9, at the surface 11 which is opposite to the surface 10 of the first flap 2.

From the point of view of the component material, the first flap 2, and therefore, optionally, the strap which constitutes it, can be made of a soft material and thus suitable for allowing the flexing of said strap for the engagement of the pivot 8 at adapted grip elements associated with the second element 3. Said grip elements can advantageously be constituted by a rack 13 having a plurality of protruding teeth for the pivot 8 and rigidly associated with the second flap 3 by means of adapted first rivets 14*a* and 14*b*.

Said material for manufacturing the first flap or the strap is thus advantageously soft plastics or a natural material such as, for example, leather or, alternatively, soft synthetic material.

The seat 9 can furthermore advantageously be obtained by mutually connecting two distinct pieces of material, for example by glueing, sewing or welding, or can be obtained directly at a single part.

Alternatively, the seat 9 can be manufactured by folding on itself the end of a single part and by then defining the seat by sewing, glueing or welding.

The connection between the pair of wings 7*a* and 7*b* and the first flap 2 can advantageously be increased by using second rivets 15*a* and 15*b*.

Figure 5:
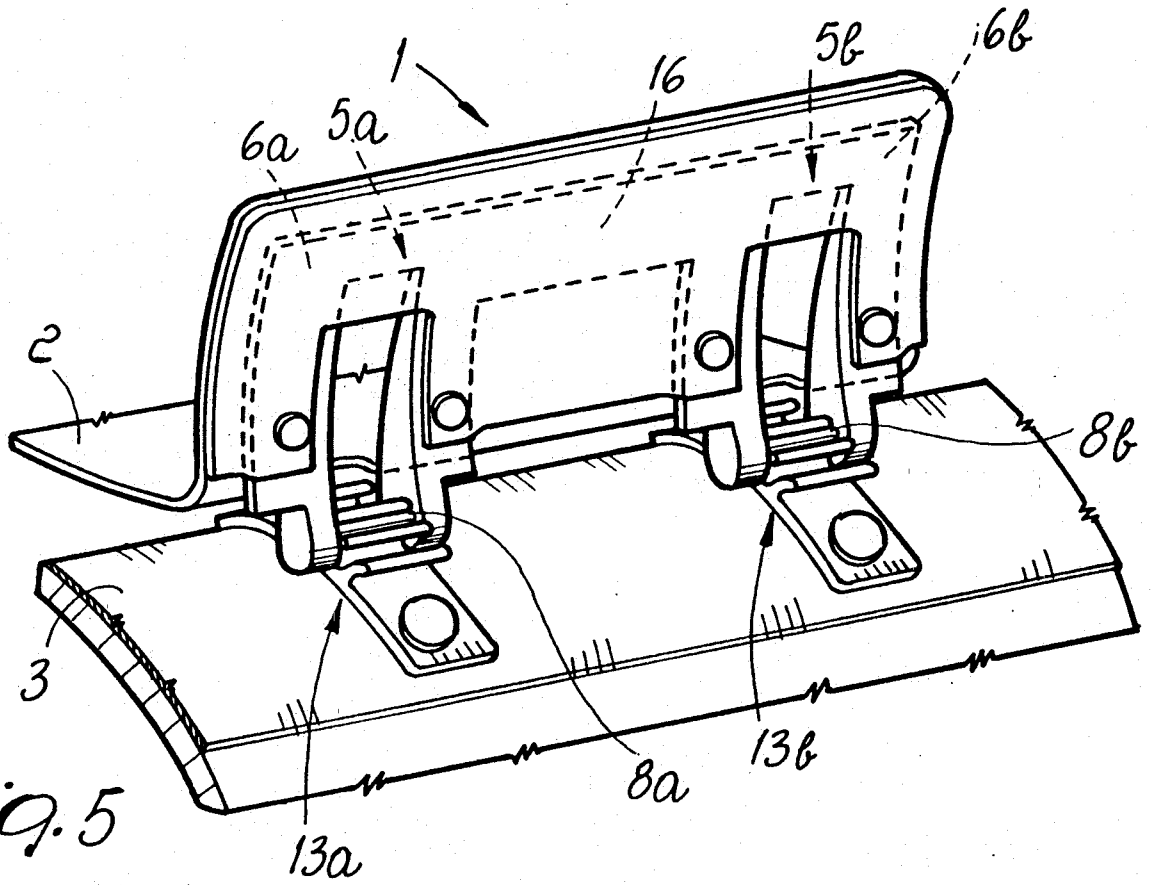
FIG. 5 is a view of the use of a lever device which comprises two engagement elements integrated in a single lever arm.

FIG. 5 illustrates the use of a lever device 1 which comprises two engagement means, indicated by the numerals 8*a* and 8*b*, which are part of a single body which is composed of two lever arms 5*a* and 5*b* which are mutually connected, at the respective bases 6*a* and 6*b*, by means of a crosspiece 16.

Two racks, indicated by the numerals 13*a* and 13*b*, are conveniently provided at the second flap 3.

It has thus been observed that the invention has achieved the intended aim and objects, a lever device having been provided which is perfectly integrated in the boot, which has a considerably appreciable aesthetic appearance, since the lever arm is totally or partially concealed in the seat defined on one of the flaps or on a band.

This also allows to use, for the lever arm, materials such as a blanked metal sheet or steel rod, having good strength but an unpleasant visual appearance.

The lever device thus obtained furthermore allows to reduce the number of components, since bases, brackets and traction elements are in fact eliminated, thus allowing to decrease the dimensions and the weight, on one hand, and the manufacturing costs on the other hand.

The lever device according to the invention is susceptible to numerous modifications and variations, all of which are within the scope of the same inventive concept.

Figure 6:
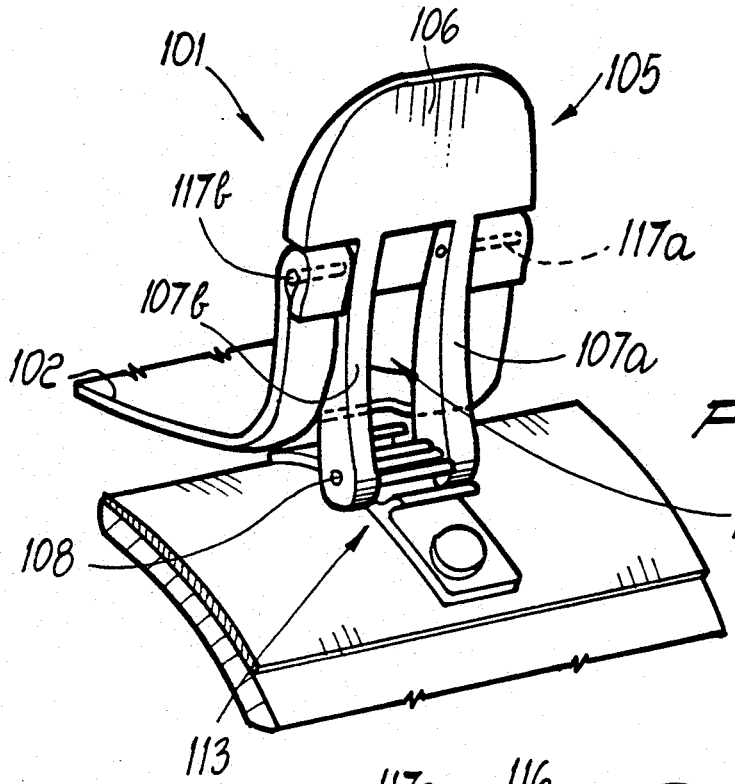
FIG. 6 is a view, similar to that of FIG. 2, of a second embodiment.
Figure 7:
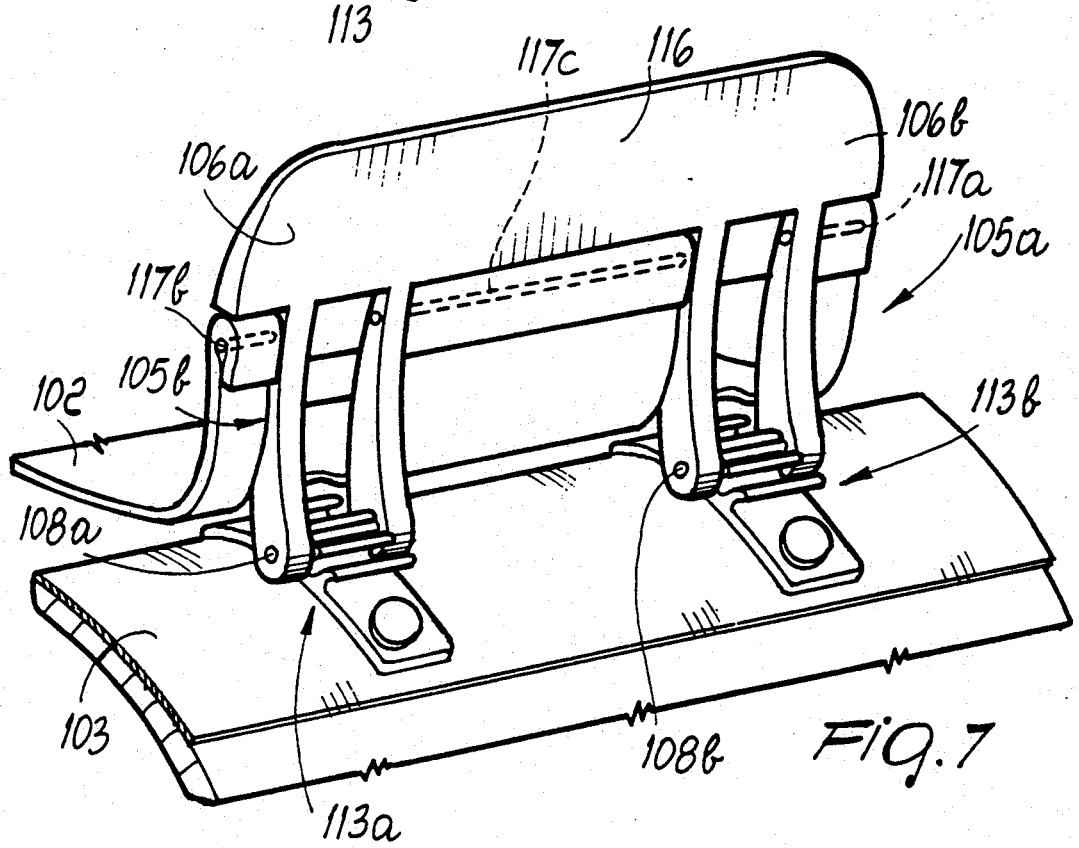
FIG. 7 is a view, similar to that of FIG. 5, of the use of two engagement elements integrated in a single lever arm with reference to the solution illustrated in FIG. 6.

Thus, for example, FIGS. 6 and 7 illustrate a second embodiment for a lever device 101 which comprises at least one lever arm 105 which has a base 106, having an arc-shaped end, from which a pair of parallel and identical wings 107*a* and 107*b* extends; an engagement means, constituted by a pivot 108, is arranged transversely at the free ends of said wings.

Said lever arm 105 thus has a T-shaped configuration, and the end of a first flap or of a strap 102 is connected to the base 106.

Said strap partially affects, and covers, part of the wing 107*a* and 107*b* proximate to their connection to the base 106, and this defines an opening 112 on said first flap or strap 102 at the interspace between said pair of wings 107*a* and 107*b*, in which the rack 113 is accommodated in a closure position of the lever arm 105.

The lever arm 105 is connected to the first flap or strap 102 by means of adapted pivots, indicated by the numerals 117*a* and 117*b*.

The lever arm 105 is thus pivoted at the first flap or strap 102.

This solution is advantageous if the material which constitutes the first flap or the strap is of the semirigid type and thus does not allow the flexing thereof for the use of the pivot 108 with the grip elements constituted by the rack 113.

FIG. 7 illustrates a lever device 101 in which a pair of engagement means 108*a* and 108*b* is used; said means are integrated in a single body which is composed of two identical lever arms, indicated by the numerals 105*a* and 105*b*, connected by a crosspiece 116 at the bases 106*a* and 106*b*.

In this case, the interconnection between the lever arms 105*a*, 105*b* and the first flap or strap 102 occurs by means of the use of pivots 117*a*, 117*b* and 117*c*, said pivot 117*c* connecting the facing wings of the two lever arms.

In this case also, a pair of racks 113*a* and 113*b* for interaction with the pivots 108*a* and 108*b* is provided at the second flap 103.

The materials which constitute the individual components of the lever device may naturally be the most pertinent according to the specific requirements.

We claim:

1. In combination, an item of sports footgear and a lever device, said sports footgear comprising a first flap and a second flap, said lever device being a lever device for securing said first flap and said second flap of the item of sports footgear, the lever device comprising:

a rack element connected to said second flap and comprising a plurality of teeth protruding from said second flap; and a lever arm having a pair of wings defining an interspace therebetween, said pair of wings being mutually interconnected at upper ends thereof by a base member and being mutually interconnected at lower ends thereof by a pivot element, said pivot element being removably and selectively pivotally engageable in one of said plurality of teeth;

said first flap being connected to said lever arm by means of a hollowed seat provided at an end of said first flap, said base of said lever arm being inserted in said hollowed seat and said lower ends of said lever arm extending out of said hollowed seat wherein a longitudinal opening is provided in said first flap at a position thereof which overlies said interspace between said pair of wings of said lever arm, said longitudinal opening of said first flap extending sufficiently so that said plurality of teeth of said rack element are accommodated therein when said lever arm is in a closure position.

2. The combination of claim 1, wherein said seat is formed by a folded end of said first flap, said folded end being rigidly connected to said lever arm by means of rivets.

3. The combination of claim 1, wherein said lever device comprises a pair of said rack elements and a pair of said lever arms, a crosspiece being interconnected between said bases of said pair of lever arms.

4. The combination of claim 1, wherein a strap element of said first flap is connected to said lever arm.

5. In combination, an item of sports footgear and a lever device, said sports footgear comprising a first flap and a second flap, said lever device being a lever device for securing said first flap and said second flap of the item of sports footgear, the lever device comprising:

a rack element connected to said second flap and comprising a plurality of teeth protruding from said second flap; and a lever arm having a pair of wings defining an interspace therebetween, said pair of wings being mutually interconnected at upper ends thereof by a base member and being mutually interconnected at lower ends thereof by a pivot element, said pivot element being removably and selectively pivotally engageable in one of said plurality of teeth;

said first flap being connected to said lever arm by means of a hollowed seat provided at an end of said first flap, said base of said lever arm being inserted in said hollowed seat and said lower ends of said lever arm extending out of said hollowed seat, wherein said lever device comprises a pair of said rack elements and a pair of said lever arms, a crosspiece being interconnected between said bases of said pair of lever arms.

6. The combination of claim 5, wherein said seat is formed by a folded end of said first flap, said folded end being rigidly connected to said lever arm by means of rivets.

7. The combination of claim 5, wherein a longitudinal opening is provided in said first flap at a position thereof which overlies said interspace between said pair of wings of said lever arm, said longitudinal opening of said first flap extending sufficiently so that said plurality of teeth of said rack element are accommodated therein when said lever arm is in a closure position.

8. The combination of claim 5, wherein a strap element of said first flap is connected to said lever arm.

9. In combination, an item of sports footgear and a lever device, said sports footgear comprising a first flap and a second flap, said lever device being a lever device for securing said first flap and said second flap of the item of sports footgear, the lever device comprising:

a rack element connected to said second flap and comprising a plurality of teeth protruding from said second flap; and a lever arm having a pair of wings defining an interspace therebetween, said pair of wings being mutually interconnected at upper ends thereof by a base member and being mutually interconnected at lower ends thereof by a pivot element, said pivot element being removably and selectively pivotally engageable in one of said plurality of teeth;

wherein said first flap is connected to said lever arm by means of folded elements of said first flap which are pivoted about a pair of pivots extending outwardly from said pair of wings just below said base of said lever arm, and wherein a longitudinal opening is provided in said first flap at a position thereof which overlies said interspace between said pair of wings of said lever arm, said longitudinal opening of said first flap extending sufficiently so that said plurality of teeth of said rack element are accommodated therein when said lever arm is in a closure position.

10. The combination of claim 9, wherein said lever device comprises a pair of said rack elements and a pair of said lever arms, a crosspiece being interconnected between said bases of said pair of lever arms.

11. The combination of claim 9, wherein a strap element of said first flap is connected to said lever arm.

* * * * *